US005931731A

United States Patent [19]

Chwalisz

[11] Patent Number: 5,931,731

[45] Date of Patent: Aug. 3, 1999

[54] ENCLOSED ROTARY-OPTIC COIN COUNTING SYSTEM

[75] Inventor: Voytek Chwalisz, Carson City, Nev.

[73] Assignee: International Game Technology, Reno, Nev.

[21] Appl. No.: 08/843,885

[22] Filed: Apr. 17, 1997

[51] Int. Cl.[6] ..... G07D 9/04

[52] U.S. Cl. ..... 453/32; 377/7

[58] Field of Search ..... 453/4, 32; 194/203; 377/7

[56] References Cited

U.S. PATENT DOCUMENTS 3,279,574 10/1966 Seiden ..... 194/242

3,680,566 8/1972 Tanaka et al. ..... 453/32

*Primary Examiner*—F. J. Bartuska

*Attorney, Agent, or Firm*—Beyer & Weaver, LLP

[57] ABSTRACT

Disclosed is an optical coin counting system for use in gaming machines such as video poker machines and slot machines. One disclosed system includes an optical detector including a light source and a light detector, a deflection arm which deflects when a coin passes over it, a shaft attached to the deflection arm such that the shaft rotates when the deflection arm deflects, an optic flag attached to the shaft at a location remote from the deflection arm such that when the coin causes the deflection arm to deflect, the optic flag moves with respect to the light detector to cause a change in light intensity detected by the detector, and an opaque barrier disposed substantially about the optic flag such that substantially all light proximate the deflection arm is blocked from reaching the optical detector. The shaft may pass through the opaque barrier.

22 Claims, 3 Drawing Sheets

ENCLOSED ROTARY-OPTIC COIN COUNTING SYSTEM

BACKGROUND OF THE INVENTION

This invention relates to optical coin counting mechanisms for coin dispensers such as those employed in gaming machines. More particularly, the present invention relates to optically isolated coin counting apparatus that resists tampering.

In gaming machines such as slot machines, coin hoppers store coins for the eventual payout. During payout, a mechanism delivers coins from the hopper to a hopper exit for collection by the player. As some winning combinations result in bigger payouts than others, the number of coins delivered from the hopper to the player must be precisely monitored. This is the role of a coin counting mechanism.

While there are a variety of available mechanisms for counting coins, optical detection devices are very widely used and are of most interest in the context of the present invention. In these devices, each coin that passes from the hopper during payout triggers a change in the intensity detected in the optical mechanism. One widely used optical coin counting mechanism now will be described with reference to FIG. 1.

As shown in FIG. 1, an optical coin counting mechanism 2 includes an optic cover 4 which houses an optical detector 6 having a light source 8 and a light intensity detector 10. Attached to optical detector 6 is wiring 12 for providing power and ground to the light source and light intensity detector. Wiring 12 also includes a signal line for transmitting signals from the light intensity detector 10 to appropriate processing electronics. Optical detector 6 includes an arm 14 which includes a threaded hole for receiving a screw 16 mounted through optic cover 4. Screw 16 holds optical detector 6 in place within optic cover 4. Both optic cover 4 and optical detector 6 may be made from molded plastic for example.

The optical detector 6 is mounted to an actuator mount 18 through a threaded hole 20. In this manner, the optic cover covers the optical detector 6 and a back portion of the actuator mount 18. Actuator mount 18 includes a mounting shaft 22 which engages an actuator 24. The actuator is pivotally mounted on mounting shaft 22 via a torsion spring 26, a washer 28 and an E-ring 30 (to prevent the actuator from sliding off the shaft). Actuator 24 includes a deflection arm 32 and a flag 34. Flag 34 is positioned near the optical detector 6 such that when the actuator 24 pivots about shaft 22, the flag moves between light source 8 and light intensity detector 10.

During operation, coins are passed from a gaming machine hopper over deflection arm 32. Each coin so transported, forces arm 32 upward so that the entire actuator 24 pivots about shaft 22. After a coin has exited the hopper, deflection arm 32 is forced downward back to its original position by torsion spring 26. Also, when actuator 24 rotates in response to a coin passing, flag 34 is directed between light source 8 and light intensity detector 10. This causes optical detector 6 to report a reduction in light intensity. Upon return of actuator 24 to its starting position (after the coin has exited the hopper), flag 34 moves away from optical detector 6 and intensity detector again reports a normal light intensity. Thus, each coin passing event is associated with a temporary reduction in intensity reported by intensity detector 10. In this manner, the coins passing from the hopper to the hopper exit can be counted.

While rotary-optic coin counting systems, such as that illustrated in FIG. 1, have found widespread acceptance, recently some nefarious individuals have attempted to defeat the optical mechanisms by fooling the optical detector into believing that no coins are being delivered when in fact numerous coins are being delivered. These individuals insert a small but highly intense light source, such as a small quartz lamp, into the gaming machine at an orientation which floods the light intensity detector with light, thereby preventing the detector from detecting light intensity reduction events associated with passing coins. Typically, the person trying to cheat the machine inserts the light source through the coin exit chute of the gaming machine while casino personnel are not observing. Obviously, this is a serious concern of casinos and gaming machine manufacturers alike. Accordingly, coin counting mechanisms able to completely resist such attempts to defeat the optical system would generally have wide appeal to the gaming industry.

SUMMARY OF THE INVENTION

The present invention meets the above-mentioned need by providing an optical coin counting system having an optical detector enclosed within an opaque structure which substantially blocks light from sources that could be inserted into the gaming machine during normal operation. Thus, it becomes nearly impossible for nefarious individuals to defeat optic coin counters by flooding the coin counter with light. The opaque enclosure prevents light radiation from any source, save the optical detector's own light source, from reaching the detector.

One specific aspect of the present invention is a gaming machine having an optical coin counting system employing an optical detection mechanism fully enclosed in an opaque enclosure. Importantly, the enclosure should block substantially all light from accessing the optical detection mechanism. The gaming machine may be characterized as including, in addition to the optical coin counting system, a coin hopper capable of storing coins and a rotary disk which delivers coins from the coin hopper to the optical coin counting system. Each coin that passes by the optical coin counting system is registered as a coin passing event (i.e., the coin is "counted"). The optical coin counting system may be disposed proximate a hopper exit such that each coin passing by the optical coin counting system passes out the hopper exit.

Another aspect of the invention provides a specific optic coin counting system which can be generally characterized as including the following features: (a) an optical detector including a light source and a light detector; (b) a deflection arm which deflects when a coin passes over it; (c) a shaft attached to the deflection arm such that the shaft rotates when the deflection arm deflects; (d) an optic flag attached to the shaft at a location remote from the deflection arm such that when the coin causes the deflection arm to deflect, the optic flag moves with respect to the light detector to cause a change in light intensity detected by the detector; and (e) an opaque barrier disposed between the deflection arm and the optic flag (or substantially about the optic flag) such that substantially all external light proximate the deflection arm is blocked from reaching the optical detector. Thus, in most constructions, the shaft passes through the opaque barrier.

In some embodiments, the opaque barrier forms part of an opaque enclosure which blocks substantially all light (regardless of origination point) from accessing the optical detector. In such embodiments, the system may be constructed such that the optic flag and the optical detector are fully enclosed by the opaque enclosure. The deflection arm is preferably located outside of the enclosure such that can be activated by coins from the hopper.

So that the deflection arm can return to a starting position after each coin passes by, a torsion spring may be mounted about the shaft. This allows the deflection arm to deflect when a coin passes over it and then causes the deflection arm to spring back to the starting position after the coin passes.

To prevent malfunction or damage to the optic coin counting system, the system may be outfitted with one or more over-travel mechanisms which block the deflection arm from deflecting more than a predefined distance. Thus, the deflection arm can not be hyperextended to a point where it damages the coin counting system.

Another aspect of the invention provides a method of counting coins with any optical coin counting system including an optical detection mechanism fully enclosed in an opaque enclosure. The method may be characterized as including (1) passing a coin by the optical coin counting system such that it causes a change in radiation intensity detected by the optical detection mechanism which is fully enclosed in the opaque enclosure and (2) registering a coin passing event (i.e., the coin is counted) for the change in radiation intensity detected by the optical detection mechanism. Other steps that may be provided in the method include delivering the coin from a coin hopper to the optical coin counting system and delivering the coin from the optical coin counting system to a coin hopper exit.

In one specific embodiment, the invention provides a method of counting coins including the following steps: (a) delivering a coin from a hopper to an optical coin counting system having an optical detection mechanism; (b) passing the coin over a deflection arm of the optical coin counting system and thereby causing the deflection arm to deflect and move an optic flag within the optical detection mechanism to thereby cause a change in radiation intensity detected by the optical detection mechanism; and (c) blocking extraneous light proximate the hopper from reaching the optical detection mechanism with an opaque barrier located between the hopper and the optic flag as described above.

The step of delivering the coin from the hopper to the optical coin counting system may include conveying the coin on a rotary disk which engages the coin in the hopper and rotates to deliver the coin to the optical coin counting system. Further, the step of passing the coin over a deflection arm causes a shaft attached to both the deflection arm and the optic flag to rotate. Still further, the step of delivering the coin from the hopper may occur when a payout event occurs on a gaming machine.

These and other features of the present invention will be presented in more detail in the following detailed description of the invention and the associated figures.

DESCRIPTION OF THE PREFERRED EMBODIMENTS

The present invention will now be described with reference to FIGS. 2 and 3. Generally, though not necessarily, the optical coin detectors of the present invention will count coins delivered from a hopper during payout from a gaming machine. "Gaming machines" in the context of this invention include at least slot machines and video poker machines. Many possible games including traditional slot games, progressive slot games, video poker, lottery, and increasingly popular multi-line games which have multiple (e.g., 8 or 15) pay lines may be provided with gaming machines of this invention.

Gaming machines generally include a housing which surrounds the machine interior where electrical, mechanical, and optical apparatus for controlling game operation may reside. The housing may include control buttons to control the type of game (or games) that can be played on the machine. A set of spinning reels or a video monitor is provided to display game play and results. In many slot machines, the spinning reels are stepper motor driven reel assemblies that each include a plurality of indicia on their periphery. If the indicia on the reels lineup in a predetermined spinning pattern, the player is paid a jackpot. The coins used for such payout are stored in a hopper that is not visible to players.

Figure 2:
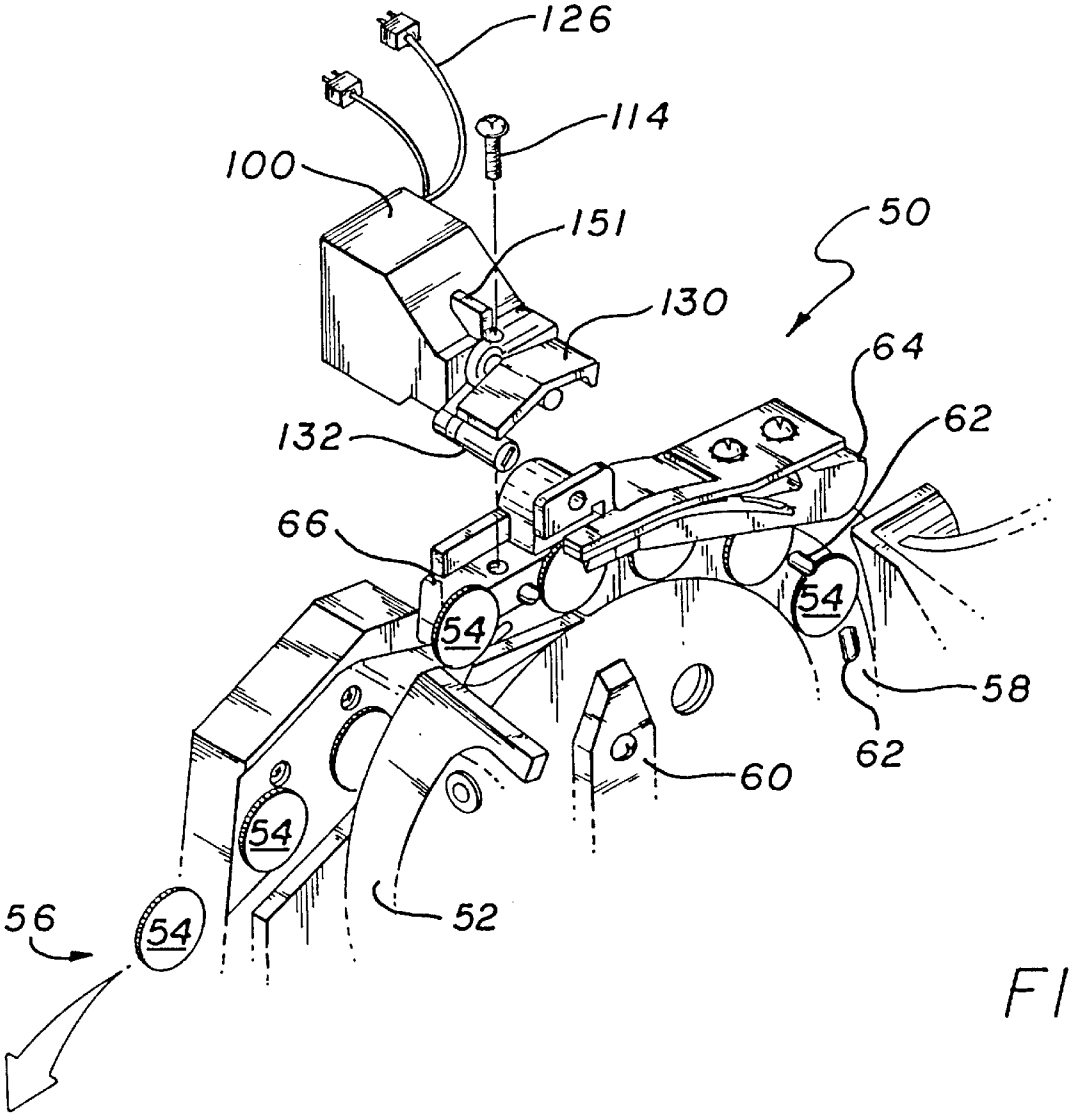
FIG. 2 is an exploded view of a coin hopper having a fully enclosed optical coin counter in accordance with one embodiment of the present invention.

Turning now to FIG. 2, a hopper arrangement 50 in accordance with one embodiment of the present invention is shown. Hopper arrangement 50 includes a hopper bowl 52 which collects and temporarily holds the coins inserted into the gaming machine to which it is attached. When a payout is required, a defined quantity of coins 54 are transported from hopper bowl 52 to a hopper exit 56 by a pin wheel 58. Hopper bowl 52 may be a molded plastic container and should generally be shaped as a bowl or other receptacle suitable for holding coins.

Mounted to pin wheel 58 is an agitator 60 which is used to stir the coins 54 within hopper bowl 52 so that those coins may be easily loaded onto the periphery of pin wheel 58. Note that agitator 60 is mounted on pin wheel 58 so that when the disk rotates, agitator 60 stirs coins 54. As those coins are stirred some of them engage the periphery of pin wheel 58 as shown. Each coin loaded onto disk 58 is separated from other coins by pins 62 which laterally protrude from the peripheral region of disk 58. In this manner, coins are delivered to the hopper exit one at a time in a frequency fixed by the disk speed and the spacing of pins 62. A coin wiper 64 serves to wipe any doubled up coins that may be attached to a single location between pins 62 on the disk periphery. This ensures that only a single coin is present between each set of adjacent pins.

Pin wheel 58 is driven by a motor and includes a plurality of pins 62 which form part of the pin wheel and protrude through holes in the periphery of pin wheel 58. As the pin wheel rotates, it pulls pin wheel 58 along with it.

A fully enclosed rotary optic coin counter 100 in accordance with one embodiment of the present invention is mounted via a screw 114 onto a mounting surface 66 on the hopper assembly 50. Coin counter 100 will be described in more detail below with reference to FIG. 3. For now, it should be noted that coin counter 100 includes an actuator 130 that has a deflection arm 132. Preferably, the deflection arm 132 is disposed proximate hopper exit 56 such that each coin 54 passing over the deflection arm and causing it to deflect as a coin passes out the hopper exit. Specifically, each coin loaded onto pin wheel 58 transferred toward the hopper exit hits deflection arm 132, causing it to deflect upward. After the coin passes by arm 132, the actuator 130 returns to its original position. This temporary deflection of actuator 130 registers a coin passing event. That is, a coin is "counted." A further discussion of this process will be described below with reference to FIG. 3. The coin counting signals are transmitted from coin counter 100 to a processor via an electric cable 126.

Data from an optical detector of coin counter 100 is transmitted to a CPU which includes the necessary processors and memory to (1) make an initial determination of whether a coin has passed by, (2) maintain a count of the total number of coins that have passed, and (3) provide pulse duration timing. Regarding the initial determination, certain changes in light intensity at a light intensity sensor of the detector indicate that a coin has passed by the coin counter. This determination may be made without regard to the coin's denomination. Regarding the CPU's counting function, the CPU's memory will contain data specifying the number of coins counted to date. This data may be used for various comparisons and calculations of use to the gaming machine and/or casino. The processor may also generate the appropriate signals for determining when a light source in the detector is turned on.

It should be understood that any light source inserted into the hopper region (including hopper bowl 52) will not be able to transmit light to an optical detector in coin counter 100. This is because coin counter 100 is fully enclosed in an opaque enclosure.

Figure 3:
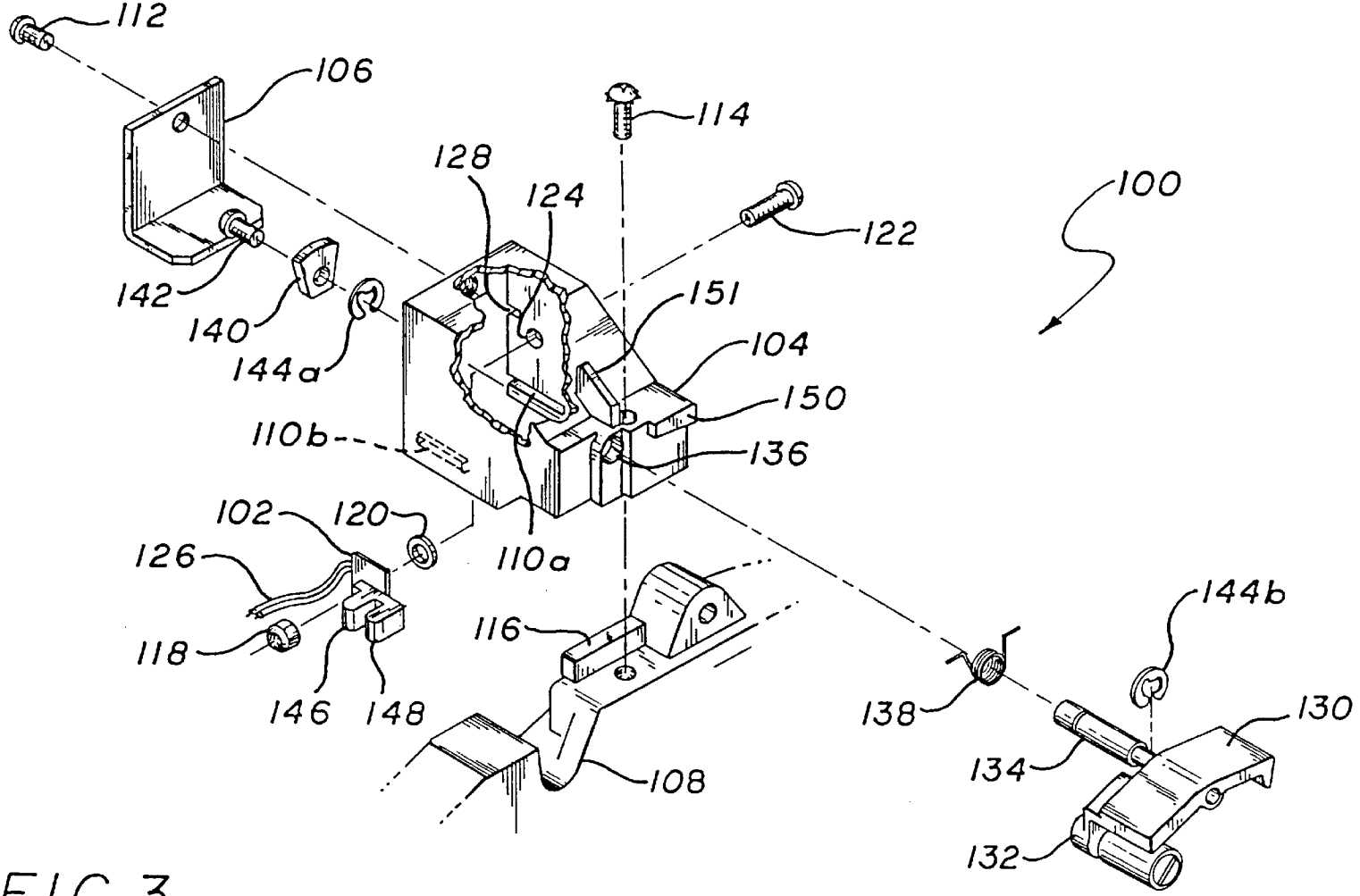
FIG. 3 is an exploded view of a fully enclosed rotary-optic coin counter in accordance with a preferred embodiment of the present invention.

FIG. 3 depicts a fully enclosed rotary-optic coin counter 100 in accordance with one embodiment of the present invention. In this embodiment, an optical detector 102 is mounted in an opaque enclosure including a main housing 104 and a back cover 106. Cover 106 and the housing 104 should be opaque to a wide range of radiation wavelengths (preferably light wavelengths from the ultraviolet through the infrared). Most importantly, these enclosure components should be opaque to wavelengths detected by optical detector 102. Together, the opaque enclosure should block substantially all external radiation (of important wavelengths) from penetrating the enclosure, or at least reaching the optical detector. In a preferred embodiment the components of the enclosure are made from molded opaque plastic.

In the embodiment shown, a bottom horizontal portion of back cover 106 slides into main housing 104 via two grooves 110*a* and 110*b*. A screw 112 holds back cover 106 in place with respect to main housing 104. Note that grooves 110*a* and b hold back cover 106 in place so that it can not rotate about screw 112. The edges of main housing 104 and back cover 106 preferably are formed such that when the pieces are put together, no light can pass through the edges to the interior of the enclosure. In alternative embodiments, an opaque glue fills the edge seams between back cover 106 and main housing 104.

Main housing 104 snaps into place on hopper housing 108 and is mounted by a single screw 114. A ridge 116 on hopper housing 108 engages main housing 104 such that coin counter 100 can not rotate about screw 114. Again the front bottom edges of main housing 104 preferably are formed to make a light tight seal with the corresponding edges (surfaces) of hopper housing 108. Additional opaque sealant may be provided to further close the seams.

Optical detector 102 is mounted on the inside of main housing 104 by a nut 118, a washer 120, and a screw 122 through a hole 124 in the side of main housing 104. Power and ground are supplied to optical detector 102 via wiring 126 which passes through a slot 128 in main housing 104. Wiring 126 also includes a signal line which takes signals from the optical detector and provides them to appropriate processing electronics. Preferably, slot 128 is sealed with an opaque sealant such as an opaque silicone around the wiring. Alternatively, a molded strain relief harness on wiring 126 could also achieve the same sealing purpose.

An actuator 130 includes a deflection arm 132 affixed to a shaft 134. Shaft 134 passes into the interior of the opaque enclosure through a hole 136 in main housing 104. A torsion spring 138 encircles shaft 134 and biases it toward a starting position. An optic flag 140 is mounted to the end of shaft 134 via a screw 142 such that it is proximate optical detector 102. Note that the optic flag 140 and the optical detector 102 are fully enclosed by the opaque enclosure, while the deflection arm and part of the shaft are located outside the enclosure. Two E-rings 144*a* and 144*b* prevent shaft 134 from sliding axially within main housing 104.

Preferably, shaft 134 is made from a high precision steel, and hole 136 in housing 104 includes a bearing sleeve made from, for example, a corrosion resistant and low friction material (e.g., certain brasses). This allows shaft 134 to rotate with minimal friction.

In the embodiment described, the optical detector (and more importantly the light intensity detector of the optical detector) is fully enclosed in the opaque enclosure. Thus, any attempts to defeat the system by inserting a strong light source up through the coin exit chute will fail because light can not penetrate the opaque enclosure to reach the optical detector. In preferred embodiments, each potential access point through the opaque enclosure to the optical detector is sealed by close tolerances, an opaque gasket or other opaque sealing method or mechanism. For example, a silicone gasket may be employed around shaft hole 136. Also, an opaque epoxy may be placed about the housing's access to wiring 126.

During operation, coins pass over deflection arm 132 and cause it to deflect from its starting position. Each deflection of arm 132 rotates shaft 134 and optic flag 140. Optic flag 140 is oriented on shaft 134 such that coin-initiated deflections cause it to pass between a light source 146 and a light intensity detector 148 of optical detector 102. This causes a reduction in intensity registered at light intensity detector 148. After the coin passes on to the coin exit chute, torsion spring 138 forces the deflection arm 132 to return to its starting position, bringing with it the optic flag 140. Thus, each coin passing event causes the light intensity detector 148 to first register a reduction in light intensity (the optic flag has passed in front of it) and then register a return to a higher light intensity (the optic flag has moved out of the light path). All the while that this coin counting operation is taking place, the opaque enclosure blocks external radiation (e.g., light) from impinging on light intensity detector 148.

It should be understood that the embodiments shown in FIGS. 2 and 3 present but a single examples of a rotary-optic coin counting system of the present invention. It is of course possible that other configurations and mechanisms could be employed to affect the same result. For example translational spring or other mechanism may be employed to return the deflection arm to its starting position. In an alternative embodiment, the deflection arm could be replaced with a circular spoked arrangement in which each coin passing out of the hopper contacts a fresh spoke, thereby causing the arrangement to rotate by fixed angular amount. Within the opaque enclosure, such rotation drives a chopper blade which blocks and then unblocks the light path between the light source and intensity detector.

Further, while the embodiment described above has employed an opaque housing that fully encloses an optical detector, it should be understood that any opaque barrier that effectively prevents external light from reaching the light intensity detector can function in accordance with this invention. Thus, for example, a sufficiently large opaque barrier placed between an actuator responsive to coin movement and the optical detector may come within the scope of this invention; a shaft as in FIG. 3 may pass through the opaque barrier. In this embodiment, the partially enclosed coin counter will block light emanating from a source inserted into the hopper from reaching the light intensity detector. Alternatively, the light detector may be fully enclosed in an enclosure that includes as one part the gaming matching housing and as another part a separate opaque barrier. The opaque barrier can be affixed to the gaming machine housing in order to block radiation from all directions.

Figure 1:
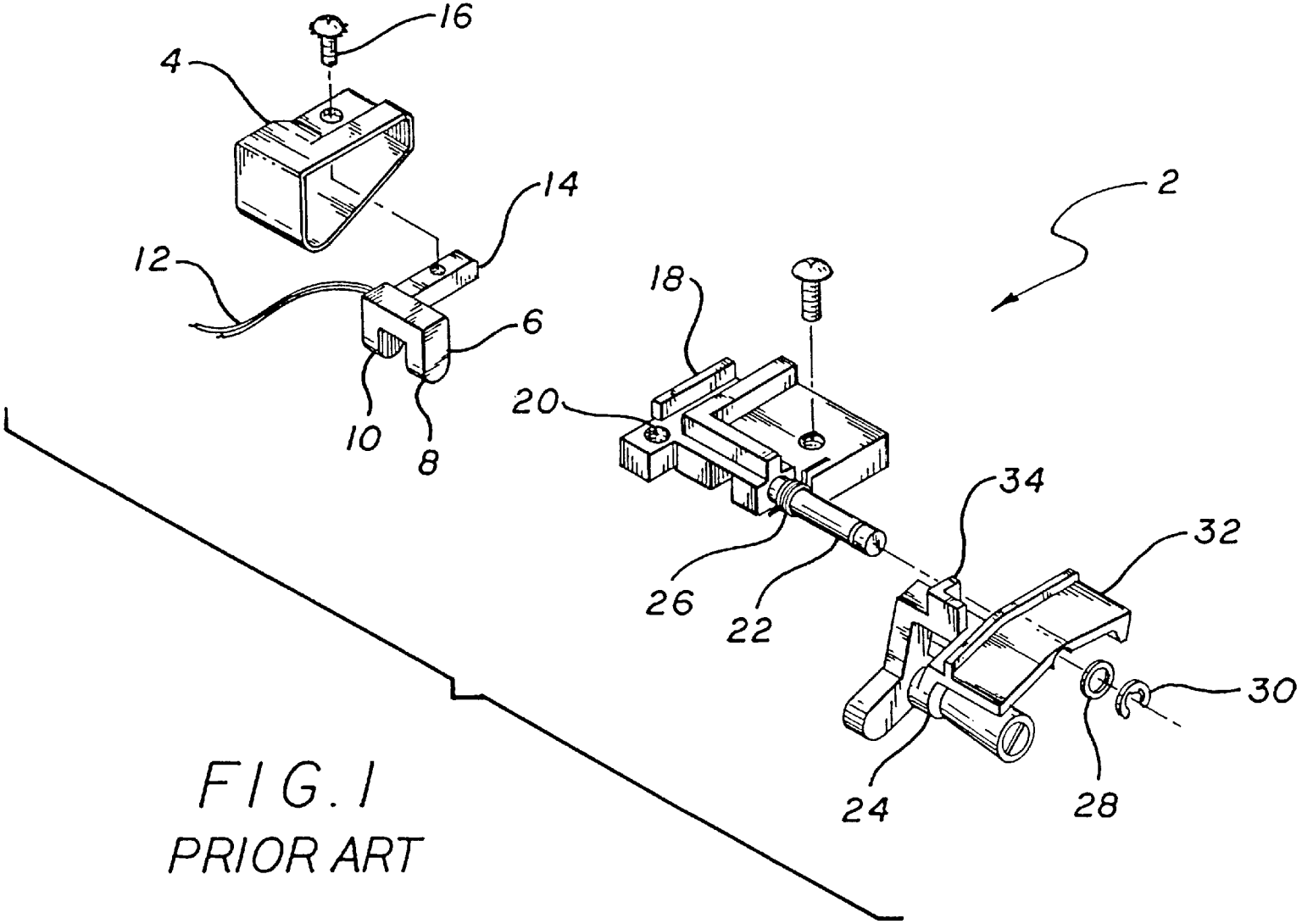
FIG. 1 PRIOR ART
FIG. 1 is an exploded view of a conventional rotary-optic coin counter for counting coins delivered from a hopper of a gaming machine.

In addition to the obvious problem of cheating the casino out of additional revenue by fooling the optic coin counter, attempts to defeat the coin counter sometimes break the deflection arm or associated apparatus. For example, while attempting to position the light source at the coin counter, a nefarious individual may push the deflection arm beyond its intended range of movement thereby breaking it or damaging its spring (e.g., torsion spring 34 of FIG. 1) so that the counter can no longer function. To address this problem, the coin counters of the present invention may be provided with a stop mechanism which limits the deflection arm's range of movement so that it can not be forced into a position which causes damage. Thus, in a preferred embodiment, the opaque enclosure is outfitted with at least one stop mechanism which blocks the deflection arm from deflecting more than a predefined distance.

In FIG. 3, main housing 104 is illustrated with a rib 150 which blocks the top portion of arm 132 from rotating beyond a starting position. If arm 132 is rotated too far in a clockwise direction, it will encounter a rib 151 and thereby be prevented from rotating further.

Although the foregoing invention has been described in some detail for purposes of clarity of understanding, it will be apparent that certain changes and modifications may be practiced within the scope of the appended claims. For instance, although the specification has described currency in the form of coins, other currency forms may be used as well. For example, tokens may also be used. In addition, the reader will understand that the coin counting system described herein can be used in systems other than gaming machines. For example, the system here taught may be used with change makers that give coin change for inserted bills. Still further, the host machine may be a vending machine such as a soda machine, a candy machine, or a cigarette machine, or an arcade game such as a video arcade game. Sometimes the coin counter will count only a single coin. In addition, the reader will understand that the rotary-optic coin counter described herein (including a deflection arm, a shaft, an optic flag, and an optical detector) may be replaced by various other optical coin counting mechanisms which could, without the protection afforded by this invention, be defeated by flooding an optical detector with light. Any arrangement will suffice so long as the optical detector is made substantially inaccessible to light.

What is claimed is:

1. A gaming machine having an optical coin counting system with an optical detection mechanism, the optical detection mechanism being fully enclosed in an opaque enclosure which blocks substantially all light from accessing the optical detection mechanism.

2. The gaming machine of claim 1, further comprising:

a coin hopper capable of holding coins; and a rotary disk which delivers coins from the coin hopper and triggers said optical coin counting system such that the optical coin counting system registers a coin passing event.

3. The gaming machine of claim 2, wherein the optical coin counting system is disposed proximate a hopper exit such that each coin passing by the optical coin counting system passes out the hopper exit.

4. The gaming machine of claim 1, wherein the gaming machine is a slot machine.

5. An optic coin counting system comprising:

an optical detector including a light source and a light detector;

a deflection arm which deflects when a coin passes over it;

a shaft attached to said deflection arm such that said shaft rotates when the deflection arm deflects;

an optic flag attached to said shaft at a location remote from said deflection arm such that when the coin causes the deflection arm to deflect, the optic flag moves with respect to said light detector to cause a change in light intensity detected by the detector; and an opaque barrier disposed substantially about said optic flag such that substantially all light proximate said deflection arm is blocked from reaching said optical detector, wherein the shaft passes through the barrier such that the optic flag is provided on one side of the barrier and the deflection arm is provided on the other side of the barrier.

6. The optic coin counting system of claim 5, further comprising a coin hopper capable of storing coins; and a rotary disk which delivers coins from the coin hopper over said deflection arm such that each coin passing over the deflection arm deflects the deflection arm.

7. The optic coin counting system of claim 6, wherein the deflection arm is disposed proximate a hopper exit such that each coin passing over the deflection arm and causing it to deflect passes out a coin exit chute.

8. The optic coin counting system of claim 5, wherein said shaft passes through the opaque barrier.

9. The optic coin counting system of claim 5, further comprising a torsion spring mounted about said shaft and allowing the deflection arm to deflect when a coin passes over it and causes the deflection arm to spring back after the coin passes.

10. The optic coin counting system of claim 5, wherein the opaque barrier forms part of an opaque enclosure which blocks substantially all light from accessing the optical detector.

11. The optic coin counting system of claim 10, wherein the optic flag and the optical detector are enclosed by said opaque enclosure.

12. The optic coin counting system of claim 5, further comprising at least one stop mechanism which blocks the deflection arm from deflecting more than a predefined distance.

13. The optic coin counting system of claim 5, wherein the optic counting system forms part of a gaming machine.

14. A method of counting coins with an optical coin counting system including an optical detection mechanism enclosed in an opaque enclosure which blocks substantially all light from accessing the optical detection mechanism, the method comprising:

passing a coin by said optical coin counting system such that it causes a change in light intensity detected by the optical detection mechanism which is fully enclosed in the opaque enclosure; and registering a coin passing event for the change in light intensity detected by the optical detection mechanism.

15. The method of claim 14, further comprising delivering said coin from a coin hopper to trigger said optical coin counting system.

16. The method of claim 14, further comprising delivering said coin from said optical coin counting system to a coin exit chute.

17. A method of counting coins with an optical coin counting system including an optical detection mechanism, the method comprising:

delivering a coin from a hopper to said optical coin counting system;

passing the coin over a deflection arm of said optical coin counting system and thereby causing the deflection arm to deflect and move an optic flag within said optical detection mechanism to thereby cause a change in light intensity detected by the optical detection mechanism; and blocking extraneous light proximate the hopper from reaching the optical detection mechanism with an opaque barrier fully enclosing said optic flag.

18. The method of claim 17, wherein delivering the coin from the hopper to the optical coin counting system includes conveying said coin on a rotary disk which engages the coin in said hopper and rotates to deliver the coin to said optical coin counting system.

19. The method of claim 17, wherein said step of passing the coin over a deflection arm causes a shaft attached to both said deflection arm and said optic flag to rotate.

20. The method of claim 17, further comprising preventing said deflection arm from deflecting more than a predefined distance.

21. The method of claim 17, wherein delivering the coin from the hopper occurs when a payout event occurs on a gaming machine.

22. The method of claim 17, further comprising delivering said coin from said optical coin counting system to a coin exit chute.

* * * * *